US009347204B2

(12) United States Patent
Kim et al.

(10) Patent No.: US 9,347,204 B2
(45) Date of Patent: May 24, 2016

(54) INTEGRATED CONTROL APPARATUS AND METHOD FOR ENGINE AND HYDRAULIC PUMP IN CONSTRUCTION MACHINE

(71) Applicant: Doosan Infracore Co., Ltd., Incheon (KR)

(72) Inventors: Dong Mok Kim, Gyeonggi-do (KR); Lee Hyoung Cho, Gyeonggi-do (KR)

(73) Assignee: Doosan Infracore Co., Ltd., Incheon (KR)

( * ) Notice: Subject to any disclaimer, the term of this patent is extended or adjusted under 35 U.S.C. 154(b) by 0 days.

(21) Appl. No.: 14/691,783

(22) Filed: Apr. 21, 2015

(65) Prior Publication Data

US 2015/0308080 A1 Oct. 29, 2015

(30) Foreign Application Priority Data

Apr. 24, 2014 (KR) ..... 10-2014-0049161

(51) Int. Cl.
*E02F 9/22* (2006.01)
*F15B 11/042* (2006.01)
*F15B 21/08* (2006.01)

(52) U.S. Cl.
CPC ..... *E02F 9/2246* (2013.01); *E02F 9/2267* (2013.01); *F15B 11/0423* (2013.01); *F15B 21/082* (2013.01); *F15B 2211/20523* (2013.01); *F15B 2211/20546* (2013.01);
(Continued)

(58) Field of Classification Search
CPC ..... B60W 10/06; E02F 9/2246
USPC ..... 701/50
See application file for complete search history.

(56) References Cited

U.S. PATENT DOCUMENTS 6,202,411 B1 3/2001 Yamashita
2007/0150166 A1* 6/2007 Mino ..... F02D 31/007 701/110

(Continued)

FOREIGN PATENT DOCUMENTS

EP 1260716 A1 11/2002
EP 2746124 A1 6/2014

(Continued)

OTHER PUBLICATIONS

European Search Report mailed Sep. 15, 2015 for European Application No. 15165093.4, 8 pages.

*Primary Examiner* — Thomas Tarcza
*Assistant Examiner* — Alex C Dunn
(74) *Attorney, Agent, or Firm* — John D. Veldhuis-Kroeze; Westman, Champlin & Koehler, P.A.

(57) ABSTRACT

An integrated control apparatus for an engine system including an engine, a hydraulic pump driven by the engine, a control valve for controlling hydraulic oil discharged from the pump and a hydraulic actuator operated by the oil from the control valve. The apparatus includes a power mode determiner calculating an auto mode change index as a function of a first state value representing a work load of the pump and a second state value representing a work speed required by an operator to determine whether a current power mode of the pump is to be changed, a pump power determiner determining a power mode of the pump based on a result of whether the current power mode of the pump is to be changed, and an engine speed determiner determining an engine speed based on the result of whether the current power mode of the pump is to be changed.

20 Claims, 5 Drawing Sheets

(52) U.S. Cl.
CPC *F15B 2211/6651* (2013.01); *F15B 2211/6652* (2013.01); *F15B 2211/6658* (2013.01)

(56) References Cited

U.S. PATENT DOCUMENTS

2010/0024412 A1* 2/2010 Hyodo ..... F16H 61/47 60/426
2010/0070146 A1* 3/2010 Ishii ..... E02F 9/2235 701/50
2011/0178684 A1* 7/2011 Umemoto ..... F16H 61/421 701/51
2012/0004816 A1* 1/2012 Okamura ..... E02F 9/2207 701/50
2012/0191307 A1* 7/2012 Matsuzaki ..... B60W 10/06 701/51
2013/0030667 A1* 1/2013 Fujimoto ..... B60W 10/06 701/93
2014/0200795 A1* 7/2014 Kawaguchi ..... F02D 31/008 701/110
2015/0006010 A1* 1/2015 Ito ..... E02F 9/2075 701/22
2015/0225927 A1* 8/2015 Hoshino ..... F02D 29/02 701/50
2015/0308078 A1* 10/2015 Lee ..... E02F 9/2025 701/50

FOREIGN PATENT DOCUMENTS

JP 2013039875 A 2/2013
WO 2008143568 A1 11/2008

* cited by examiner

INTEGRATED CONTROL APPARATUS AND METHOD FOR ENGINE AND HYDRAULIC PUMP IN CONSTRUCTION MACHINE

CROSS-REFERENCE TO RELATED APPLICATION

This application claims priority under 35 USC §119 to Korean Patent Application No. 10-2014-0049161, filed on Apr. 24, 2014 in the Korean Intellectual Property Office (KIPO), the contents of which are herein incorporated by reference in their entirety.

BACKGROUND

1. Field

Example embodiments relate to an integrated control apparatus and method for engine and hydraulic pump in a construction machine. More particularly, example embodiments relate to an apparatus and method of controlling an engine and a hydraulic pump in a construction machine such as an excavator.

2. Description of the Related Art

In general, a construction machine, such as excavator, may include a diesel engine as a prime mover, at least one variable displacement hydraulic pump, driven by the engine, and a plurality of hydraulic actuators operated by a hydraulic oil delivered from the hydraulic pump, thereby performing desired work.

An operator may manually select a power mode of the hydraulic pump in different working situations, so that the engine and the hydraulic pump may be controlled according to a predetermined output ratio in the power mode selected directly by an operator.

However, an unskilled operator may have difficulties in manually selecting an optimal power mode adapted for the working situation, and in a working state of the construction machine, both of a variation of a work load and an intention of an operator may not be considered together and also an optimal power mode based upon the considerations may not be automatically selected. Accordingly, an engine-pump power matching may not be achieved completely and consistently, thereby deteriorating fuel efficiency.

SUMMARY

Example embodiments provide an integrated control apparatus for engine and hydraulic pump in a construction machine capable of automatically changing a power mode to improve fuel efficiency.

Example embodiments provide a method of controlling an engine and a hydraulic pump using the above integrated control apparatus.

According to example embodiments, an integrated control apparatus for engine and hydraulic pump in an engine system, the engine system including an engine, comprising an engine, a hydraulic pump driven by the engine, a control valve for controlling a hydraulic oil discharged from the hydraulic pump and a hydraulic actuator operated by the hydraulic oil from the control valve, includes a power mode determiner calculating an auto mode change index as a function of a first state value representing a work load of the hydraulic pump and a second state value representing a work speed required by an operator to determine whether a current power mode of the hydraulic pump is to be changed, a pump power determiner determining a power mode of the hydraulic pump based on a result of whether a current power mode of the hydraulic pump is to be changed, and an engine speed determiner determining an engine speed based on the result of whether a current power mode of the hydraulic pump is to be changed.

In example embodiments, the power mode determiner may include a change index calculator calculating the auto mode change index as a ratio of the first state value and the second state value, and a change index determiner determining a new power mode to which a current power mode of the hydraulic pump is to be changed.

In example embodiments, the power mode determiner may further include a change standard determiner determining a power mode change standard using the current power mode and the auto mode change index as an input value.

In example embodiments, the first state value may include a discharge pressure of the hydraulic oil discharged from the hydraulic pump, and the second state value may include a negative control pressure or a pilot pressure corresponding to a control method in a hydraulic system.

In example embodiments, the first state value may include a pump power or a pump torque of the hydraulic pump, and the second state value may include a negative control pressure or a pilot pressure corresponding to a control method in a hydraulic system.

In example embodiments, the integrated control apparatus may further include a pump power calculator which calculates a pump power of the hydraulic pump from the pump torque of the hydraulic pump and an engine speed.

In example embodiments, the pump torque may be obtained from a discharge volume of the hydraulic pump and a discharge pressure of the hydraulic pump.

In example embodiments, the discharge volume may be calculated using the discharge pressure, the negative control pressure and a power shift control pressure.

In example embodiments, when an operator selects an auto mode as a power mode, the power mode determiner may determine whether a current power mode of the hydraulic pump is to be changed.

In example embodiments, the determination of the auto change of power mode is performed by comparing a duration time of the auto mode change index existing in the auto change boundary region with a standard time.

According to example embodiments, in an integrated control method for engine and hydraulic pump, a first state value representing a work load of a hydraulic pump and a second state value representing a work speed required by an operator are obtained, the hydraulic pump driven by an engine and discharging a hydraulic oil for operating a hydraulic actuator. An auto mode change index is calculated as a function of the first state value and the second state value to determine whether a current power mode of the hydraulic pump is to be changed. A power mode of the hydraulic pump is determined based on a result of whether a current power mode of the hydraulic pump is to be changed. An engine speed is determined based on the result of whether a current power mode of the hydraulic pump is to be changed.

In example embodiments, determining whether a current power mode of the hydraulic pump is to be changed may include calculating the auto mode change index as a ratio of the first state value and the second state value, and determining a new power mode to which a current power mode of the hydraulic pump is to be changed based on the auto mode change index.

In example embodiments, determining whether a current power mode of the hydraulic pump is to be changed may further include determining a power mode change standard using the current power mode and the auto mode change index as an input value.

In example embodiments, the first state value may include a discharge pressure of the hydraulic oil discharged from the hydraulic pump, and the second state value may include a negative control pressure or a pilot pressure corresponding to a control method in a hydraulic system.

In example embodiments, the first state value may include a pump power or a pump torque of the hydraulic pump, and the second state value may include a negative control pressure or a pilot pressure corresponding to a control method in a hydraulic system.

In example embodiments, the integrated control method may further include calculating a pump power of the hydraulic pump from the pump torque of the hydraulic pump and an engine speed.

In example embodiments, the pump torque may be obtained from a discharge volume of the hydraulic pump and a discharge pressure of the hydraulic pump.

In example embodiments, the discharge volume may be calculated using the discharge pressure, the negative control pressure and a power shift control pressure.

In example embodiments, when an operator selects an auto mode as a power mode, determining whether a current power mode of the hydraulic pump is to be changed may be performed.

In example embodiments, determining whether a current power mode of the hydraulic pump is to be changed may include comparing a duration time of the auto mode change index existing in the auto change boundary region with a standard time.

According to example embodiments, when an operator selects an auto mode as a power mode in a hydraulic system, an auto mode change index may be calculated based on a work load of the hydraulic pump and a work speed required by an operator to determine whether a current power mode of the hydraulic pump is to be changed. A power mode of the hydraulic pump as well as a speed of the engine may be determined based on a result of whether a current power mode of the hydraulic pump is to be changed.

Accordingly, the auto mode in a construction machine may provide convenience in selection of an optimal power mode for an unskilled operator, who cannot select skillfully a proper mode of a plurality of the power modes in different working situations. Further, the engine and the hydraulic pump may be controlled together in consideration of an output (power) of the vehicle, thereby obtaining improved fuel efficiency due to a reduction of torque requirement of the hydraulic pump.

BRIEF DESCRIPTION OF THE DRAWINGS

Example embodiments will be more clearly understood from the following detailed description taken in conjunction with the accompanying drawings.

FIG. 1 is a block diagram illustrating an engine system of a construction machine in accordance with example embodiments.

FIG. 2 is a block diagram illustrating an integrated control apparatus for engine and hydraulic pump in FIG. 1.

FIG. 3 is a block diagram illustrating a power mode determiner in FIG. 2.

FIG. 4 is a block diagram illustrating an integrated control apparatus for engine and hydraulic pump in accordance with example embodiments.

FIG. 5 is a block diagram illustrating a pump power calculator in FIG. 4.

FIG. 6 is a block diagram illustrating a power mode determiner in FIG. 4.

FIG. 7 is graphs illustrating a pump power and an auto mode change index of a hydraulic pump versus time.

FIG. 8 is a graph illustrating an auto mode change index versus time with a power mode change standard.

FIG. 9 is a flow chart illustrating an integrated control method for engine and hydraulic pump in accordance with example embodiments.

DESCRIPTION OF EMBODIMENTS

Figure 1:
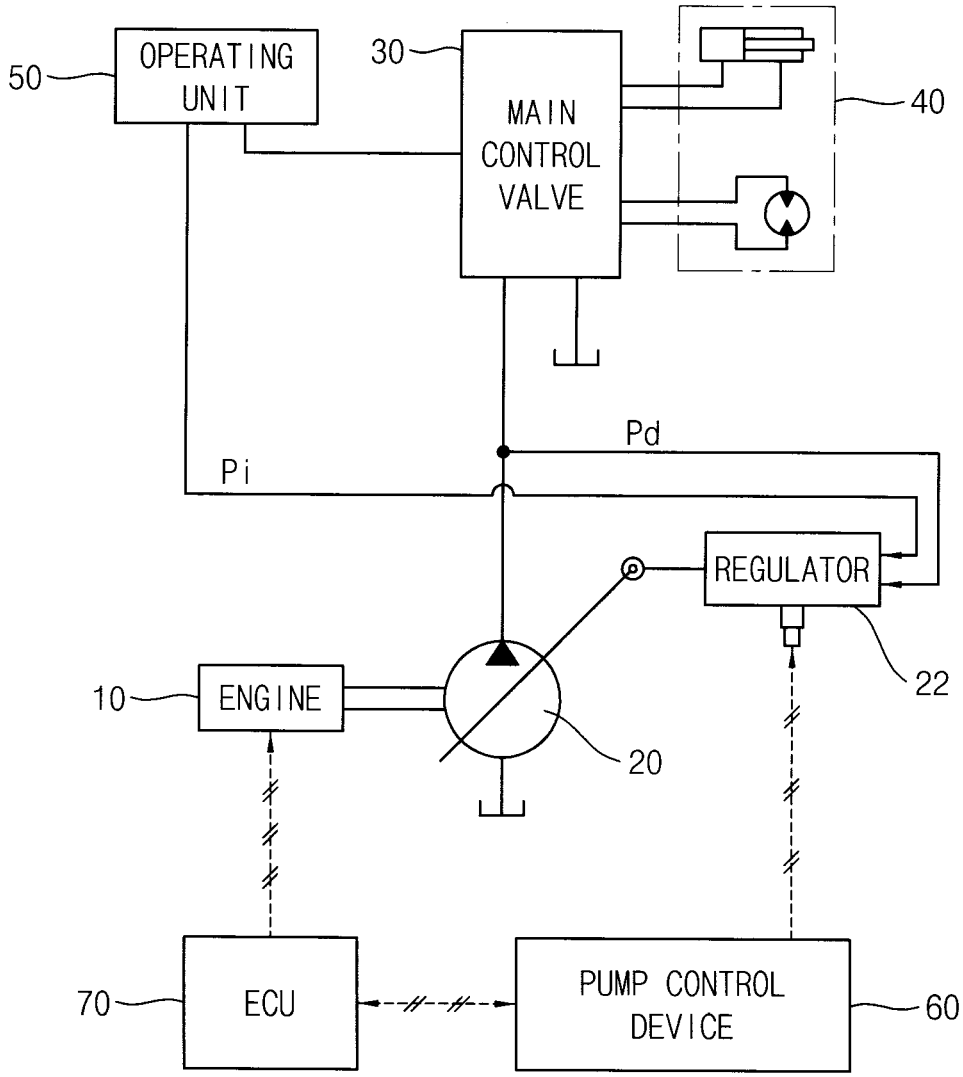
FIGS. 1 to 9 represent non-limiting, example embodiments as described herein.

Various example embodiments will be described more fully hereinafter with reference to the accompanying drawings, in which some example embodiments are shown. The present inventive concept may, however, be embodied in many different forms and should not be construed as limited to the example embodiments set forth herein. Rather, these example embodiments are provided so that this description will be thorough and complete, and will fully convey the scope of the present inventive concept to those skilled in the art. In the drawings, the sizes and relative sizes of layers and regions may be exaggerated for clarity.

It will be understood that when an element or layer is referred to as being "on," "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numerals refer to like elements throughout. As used herein, the term "and/or" includes any and all combinations of one or more of the associated listed items.

It will be understood that, although the terms first, second, third, fourth etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present inventive concept.

The terminology used herein is for the purpose of describing particular example embodiments only and is not intended to be limiting of the present inventive concept. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Figure 2:
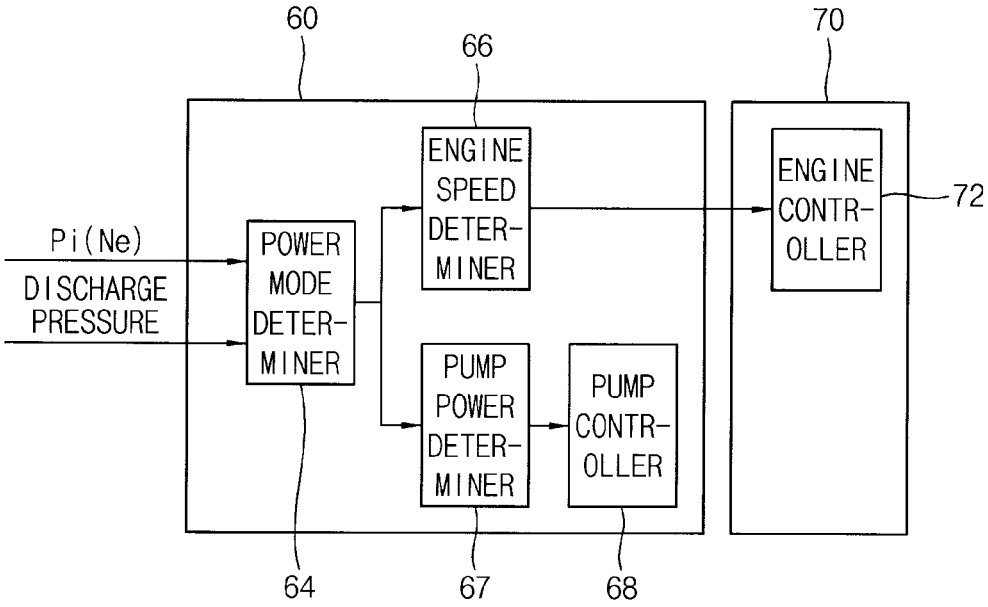
Figure 3:
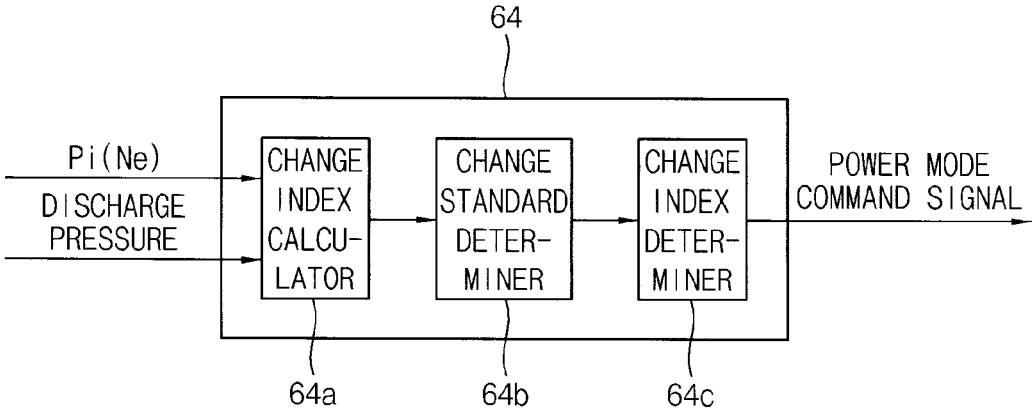

FIG. 1 is a block diagram illustrating an engine system of a construction machine in accordance with example embodiments. FIG. 2 is a block diagram illustrating an integrated control apparatus for engine and hydraulic pump in FIG. 1. FIG. 3 is a block diagram illustrating a power mode determiner in FIG. 2.

Referring to FIGS. 1 to 3, an engine system may include an internal combustion engine 10, a hydraulic pump 20 driven by the engine 10, and a hydraulic actuator 40 operated by a hydraulic oil discharged from the hydraulic pump 20.

In example embodiments, the engine 10 may include a diesel engine as a driving source for a construction machine, for example, excavator. An amount of a fuel injected into a cylinder of the engine 10 may be controlled to adjust an output torque of the engine 10.

A variable displacement hydraulic pump 20 may be connected to an output shaft of the engine 10, and the output shaft may be rotated to drive the hydraulic pump 20. A swash plate angle of the hydraulic pump 20 may be adjusted by a regulator 22, and a discharge flow rate of the hydraulic pump 20 may be regulated according to the swash plate angle. The regulator 22 may include an electronic proportional control valve. The regulator may be controlled based on a control signal from a pump control device (EPOS) 60.

The hydraulic oil discharge from the hydraulic pump 20 may be supplied to a control valve 30 and a spool of the control valve 30 may actuate such that the hydraulic oil may be supplied to the hydraulic actuator 40 corresponding to the spool.

For example, the construction machine such as the excavator may include a lower traveling body, an upper swing body rotatably mounted on the lower traveling body, a cab installed in the upper swing body, and a working device including a boom, an arm and a bucket. The hydraulic actuators such as a boom cylinder, an arm cylinder, a bucket cylinder, a traveling hydraulic motor and a swing motor may be driven by a hydraulic pressure of the hydraulic oil discharged from the hydraulic pump 20.

An operator may operate an operation lever such as joystick, pedal, etc in an operating unit 50, to generate a flow rate control signal (pilot pressure, Pi) in proportion to the operation rate of the operation lever via a pilot oil. The flow rate control signal Pi may be supplied to the regulator 22 and the control valve 30. In addition, the operating unit 50 may output various operating signals in accordance with operation rates to the pump control device 60.

For example, the discharge flow rate of the hydraulic pump 20 may be controlled in proportion to variation in required pressure according to the flow rate control signal (flow rate control), controlled to maintain a constant horse power (constant horse power control), and controlled using a power shift control pressure Pf according to a load condition of the engine (power shift control). For example, in the flow rate control, the discharge flow rate of the hydraulic pump 20 may be controlled using a negative control pressure Ne which is center-bypassed.

In example embodiments, an integrated control apparatus for engine and hydraulic pump may include the pump control device 60, an engine control unit (ECU) 70, various sensors and various setting units to perform a desired control operation.

The cab may have a monitor panel functioning as one of the setting units for allowing an operator to select a desired working mode or power mode of a plurality of working modes or power modes. The working modes may represent the kind of basic operations to be performed by the construction machine, and the power modes may represent a control mode for instructing an engine output and an output ratio of the hydraulic pump to the engine.

For example, the power modes may include A mode (Auto mode), P+ mode, P mode, S mode and E mode. When P+ mode, P mode, S mode or E mode is selected by an operator, the engine and the hydraulic pump may be controlled according to a predetermined output ratio in the selected power mode.

When A mode is selected by an operator, one of the power modes (that is, one of P+ mode, P mode, S mode and E mode) may be automatically selected based on the output (power) of the hydraulic pump. An initial mode in A mode may be preset to S mode or E mode by an operator's selection. In case that A mode is selected, an optimal control mode may be automatically selected and changed in consideration of variation in the pump power of the hydraulic pump in a current working situation, without an operator's direct manual selection and instruction for a certain power mode.

Figure 4:
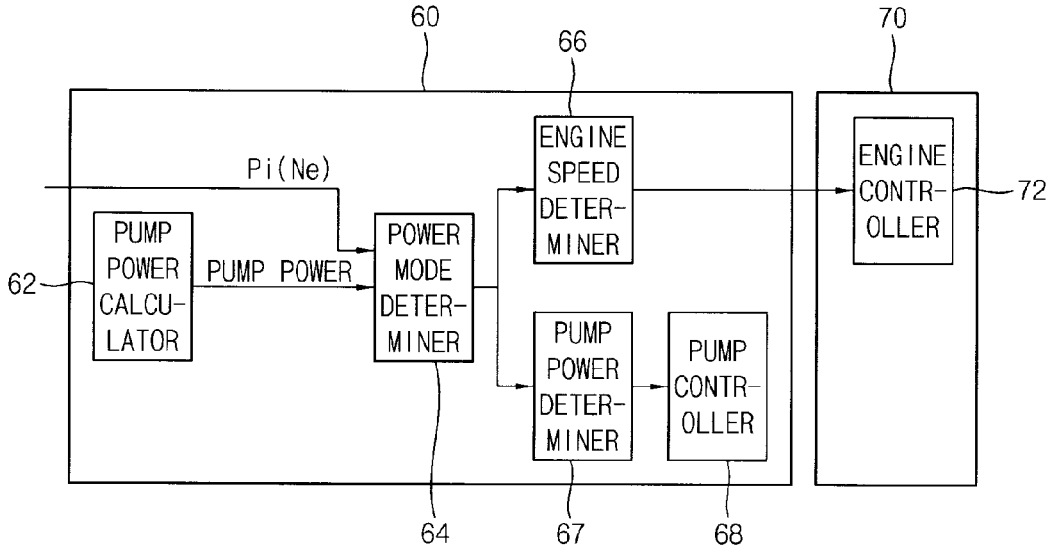

As illustrated in FIGS. 2 to 4, the integrated control apparatus for engine and hydraulic pump may include a power mode determiner 64, a pump power determiner 67 and an engine speed determiner 66. The power mode determiner 64 may calculate an auto mode change index as a function of a first state value representing a work load of the hydraulic pump 20 and a second state value representing a work speed required by an operator to determine whether a current power mode of the hydraulic pump is to be changed. The pump power determiner 67 may determine a power mode of the hydraulic pump based on a result of whether a current power mode of the hydraulic pump is to be changed. The engine speed determiner 66 may determine an engine speed based on the result of whether a current power mode of the hydraulic pump is to be changed.

As illustrated in FIG. 3, the power mode determiner 64 may include a change index calculator 64*a* calculating the auto mode change index as a ratio of the first state value and the second state value, and a change index determiner 64*c* determining a new power mode to which a current power mode is to be changed. The power mode determiner 64 may further include a change standard determiner 64*b* determining a power mode change standard using the current power mode and the auto mode change index as an input value.

The change index calculator 64*a* may calculate an auto mode change index in consideration of a control method in a hydraulic system. For example, in case of the NegaCon type control method using the negative control pressure, the auto mode change index may be determined as a ratio of a discharge pressure Pd of the hydraulic pump to the negative control pressure Ne. The auto mode change index may be calculated by following Equation (1).

$$\text{Change Index} = \text{Discharge Pressure(Pd)}/\text{Negative Condition Pressure(Ne)} \qquad \text{Equation (1)}$$

The discharge pressure Pd of the hydraulic pump may be a first state information value (hereinafter, referred to as "first state value") representing a work load of the hydraulic pump 20, that is, a load exerted on the vehicle, the negative condition pressure Ne may be a second state information value (hereinafter, referred to as "second state value") representing a pressure of the hydraulic oil discharged from the control valve 30, that is, a work speed of the work machine which required by an operator. Accordingly, a ratio of the work load and the required work speed may be used to calculate the auto mode change index. The auto mode change index may be calculated using a pump torque or pump power, instead of the discharge pressure Pd.

The change index determiner 64*c* may evaluate the calculated auto mode change index with reference to the power mode change standard determined by the change standard determiner 64*b* to determine whether a current power mode of the hydraulic pump 20 is to be changed.

For example, 1) in case of high work load and fast work speed, auto mode change index may be high, and thus, current power mode may be changed to higher power mode. That is, in case of high work load (high discharge pressure Pd), fast work speed and operator's high input value (low negative control pressure Ne), a power mode may be changed into a higher mode.

2) In case of high work load and slow work speed, auto mode change index may be low, and thus, current power mode may be maintained. That is, in case of high work load (high Pd), slow work speed and operator's low input value (high Ne), current power mode may be maintained.

3) In case of low work load and fast work speed, auto mode change index may be low, and thus, current power mode may be maintained. That is, in case of low work load (low Pd), fast work speed and operator's high input value (low Ne), current power mode may be maintained.

4) In case of low work load and slow work speed, auto mode change index may be lower, and thus, current power mode may be changed to a lower power mode. That is, in case of low work load (low Pd), slow work speed and operator's low input value (high Ne), a power mode may be changed into a lower mode.

Alternatively, in case of a control method without using the negative control pressure, the auto mode change index may be determined as a ratio of a discharge pressure Pd of the hydraulic pump and the pilot pressure Pi.

The change index determiner 64*c* may generate and output a power mode command signal for power mode increase/decrease/maintenance based on the determination result. The pump power determiner 67 may receive the power mode command signal from the change index determiner 64*c* to determine a power mode of the hydraulic pump 20. A pump controller 68 may control a power mode of the hydraulic pump 20 based on a control signal from the pump power determiner 67. For example, the pump power determiner 67 may determine a limited power output value of the hydraulic pump according to the determined power mode of the hydraulic pump 20. Accordingly, a power output of the hydraulic pump 20 may be limited to the maximum output value of the hydraulic pump 20 in the power mode determined in the pump power determiner 67.

The engine speed determiner 66 may receive the power mode command signal from the change index determiner 64*c* to determine an engine speed of the engine 10. The speed of the engine 10 may be set in proportion to the pump power of the hydraulic pump 20 or in accordance with the power modes of the hydraulic pump 20. An engine controller 72 of the engine control unit 70 may receive an engine speed control signal from the engine speed determiner 66 via CAN protocol and control a speed of the engine 10 such that power matching of the engine with the newly determined power mode can be achieved easily and consistently.

As mentioned above, when an operator selects an auto mode as a power mode in a hydraulic system, the power mode determiner may calculate an auto mode change index based on a work load of the hydraulic pump (a first state value) and a work speed required by an operator (a second state value) to determine whether a current power mode of the hydraulic pump is to be changed. A power mode of the hydraulic pump as well as a speed of the engine may be determined based on a result of whether a current power mode of the hydraulic pump is to be changed.

Thus, the auto mode in the construction machine may provide convenience in selection of an optimal power mode for an unskilled operator, who cannot select skillfully a proper mode of a plurality of the power modes in different working situations. Further, the engine and the hydraulic pump may be controlled together in consideration of an output (power) of the vehicle, thereby obtaining improved fuel efficiency due to a reduction of torque requirement of the hydraulic pump.

Figure 5:
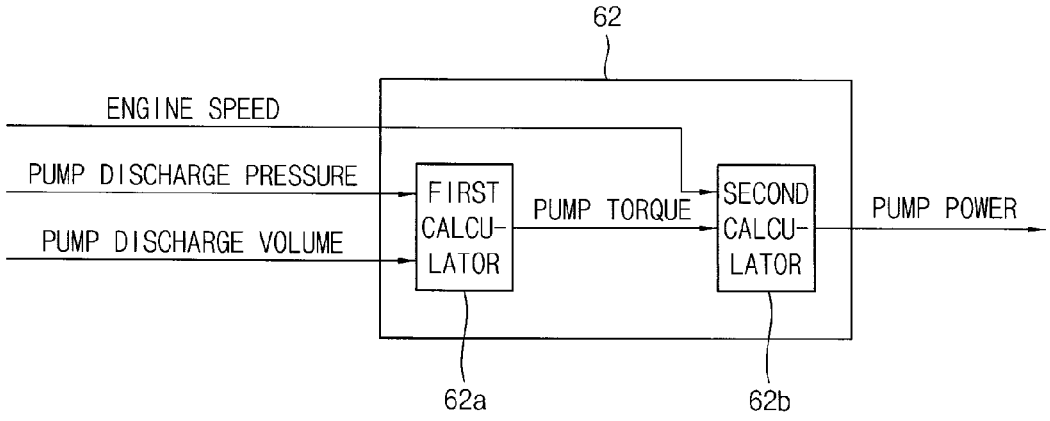
Figure 6:
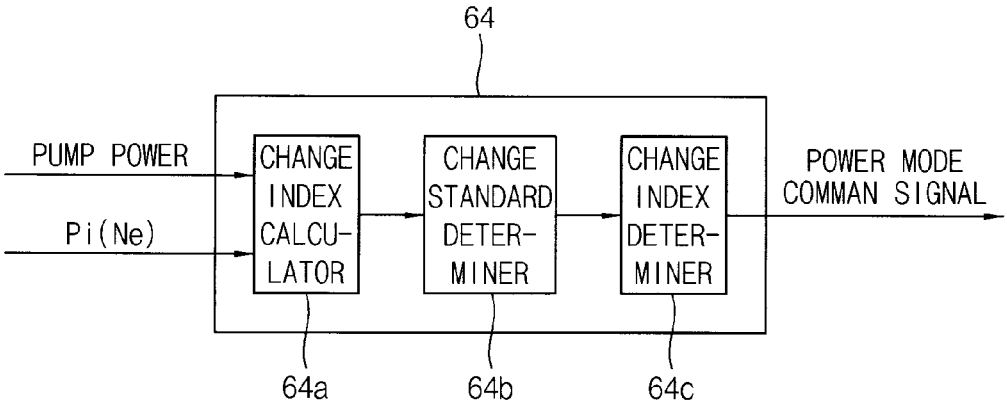

FIG. 4 is a block diagram illustrating an integrated control apparatus for engine and hydraulic pump in accordance with example embodiments. FIG. 5 is a block diagram illustrating a pump power calculator in FIG. 4. FIG. 6 is a block diagram illustrating a power mode determiner in FIG. 4. The integrated control apparatus for engine and hydraulic pump may be substantially the same as or similar to the integrated control apparatus described with reference to FIGS. 1 to 3, except for a method of calculating an auto mode change index. Thus, same reference numerals may be used to refer to the same or like elements, and any further repetitive explanation concerning the above elements will be omitted.

Referring to FIGS. 4 to 6, an integrated control apparatus for engine and hydraulic pump may further include a pump power calculator 62 which calculates a pump power of a hydraulic pump from a pump torque of the hydraulic pump and an engine speed.

As illustrated in FIG. 5, the pump power calculator 62 may include a first calculator 62*a* obtaining a pump torque of the hydraulic pump 20 and a second calculator 62*b* obtaining a pump power of the hydraulic pump 20 from the pump torque and an engine speed.

The first calculator 62*a* may estimate a pump torque of the hydraulic pump 20 from a discharge volume (displacement) of the hydraulic pump 20 and a discharge pressure of the hydraulic pump 20.

For example, a swash plate angle of the hydraulic pump 20 may be detected by an angle sensor to determine the discharge volume of the hydraulic pump 20. Alternatively, the discharge volume of the hydraulic pump 20 may be estimated using a control pressure inputted to a regulator 22 or a table obtained from measurement tests. The discharge volume of the hydraulic pump 20 may be calculated using a discharge pressure Pd, a negative control pressure Ne and a power shift control pressure Pf.

The pump torque of the hydraulic pump 20 may be calculated by following Equation (2).

$$\text{Pump Torque}=(\text{Pump Displacement}(D)\times\text{Discharge Pressure}(P))/(2\pi) \qquad \text{Equation (2)}$$

Alternatively, the pump torque of the hydraulic pump 20 may be estimated using a table obtained from measurement tests.

The second calculator 62*b* may calculate a pump power of the hydraulic pump 20 from the pump torque obtained by the first calculator 62*a* and an engine speed (rpm) of the engine 10.

The pump power of the hydraulic pump 20 may be calculated by following Equation (3).

$$\text{Pump Power}=\text{Discharge Pressure}(P)\times\text{Discharge Flow Rate}(Q) \qquad \text{Equation (3)}$$

As illustrated in FIG. 6, a power mode determiner 64 may include a change index calculator 64*a* calculating a auto mode change index as a function of the calculated pump power, a change standard determiner 64*b* determining a power mode change standard using a current power mode and the auto mode change index as an input value, and a change index determiner 64*c* determining a new power mode to which a current power mode is to be changed.

The auto mode change index may be determined by the pump power and a pilot pressure or by pump power and the negative control pressure corresponding to a control method in a hydraulic system. For example, the auto mode change index may be defined by following Equation (4).

$$\text{Change Index}=f(\text{Pump Power(Power)},\text{Pi}) \qquad \text{Equation (4)}$$

The change standard determiner 64*b* may receive the auto mode change index from the change index calculator 64*a* as an input value and output a standard time (time limit) for each control mode using a predetermined table as an output value.

The change index determiner 64*c* may evaluate the calculate the auto mode change index with reference to the power mode change standard determined by the change standard determiner 64*b* to determine whether a current power mode of the hydraulic pump 20 is to be changed.

For example, 1) in case that auto mode change index is higher than upper limit of current power mode (high work load and operator's low input value), current power mode may be maintained. 2) In case that auto mode change index is lower than upper limit of current power mode (actual work load is not high and operator's input is high), a power mode may be increased to a higher mode. 3) In case that auto mode change index is higher than lower limit of current power mode (high work load and an operator's low input value), current power mode may be maintained. 4) In case that auto mode change index is lower than lower limit of current power mode (low work load and operator's low input), a power mode may be decreased to a lower mode.

Figure 7:
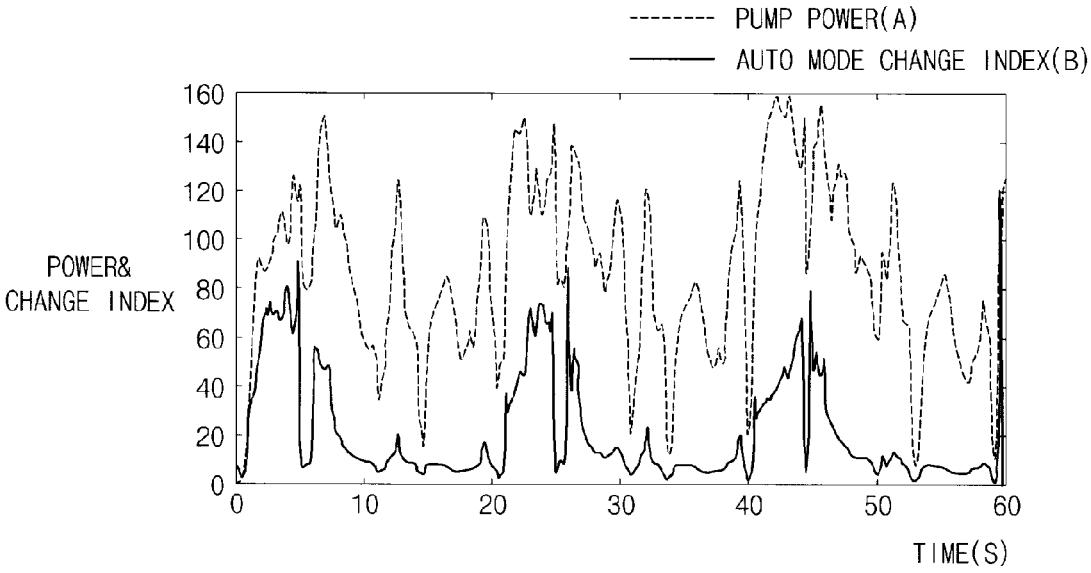
Figure 8:
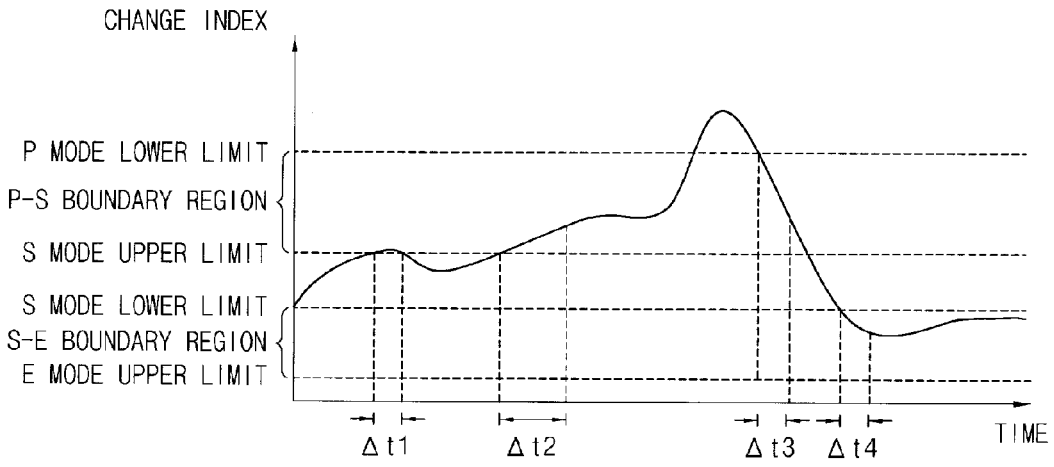

FIG. 7 is graphs illustrating a pump power and an auto mode change index of a hydraulic pump versus time. FIG. 8 is a graph illustrating an auto mode change index versus time with a power mode change standard.

Referring to FIG. 7, a pump power (A) may be calculated from a pump torque of the hydraulic pump and an engine speed or calculated by multiplication of a discharge pressure and a discharge flow rate of the hydraulic pump, and an auto mode change index (B) may be calculated as a ratio of a discharge pressure of the hydraulic pump and a negative control pressure. Since the auto mode change index (B) represents undulations in the graph more apparently than the pump power (A), the auto mode change index may be selected to determine whether the change index exceeds upper limit or lower limit for a predetermined standard time.

Referring to FIG. 8, the auto mode change index may be evaluated with reference to the determined power mode change standard to determine whether a current power mode of the hydraulic pump 20 is to be changed.

In a conventional manual type power mode selection, one boundary line may be used as a mode boundary line to distinguish between power modes. Accordingly, when a power mode is automatically selected using the boundary line as a standard line, a power mode change may occur frequently in the vicinity of the boundary line, thereby causing difficulties in manipulating working apparatus and deteriorating affective quality.

In example embodiments, in an automatic selection of power mode (Auto Mode), auto change boundary region may be defined between power modes and a power mode change may be determined based on a result of whether a change index exceeds upper limit or lower limit of the auto change boundary region. For example, the auto change boundary region for each mode change may be determined to have upper limit and lower limit, and an auto change of power mode may be determined based on a result of whether the auto mode change index exceeds upper limit or lower limit for a predetermined standard time. Accordingly, because the auto change of power mode may be determined using the boundary region, not the boundary line, a power mode change may be prevented from occurring frequently.

As illustrated in FIG. 8, P-S boundary region may be determined between S mode upper limit and P mode lower limit, and S-E boundary region may be determined between E mode upper limit and S mode lower limit. Each bound region between power modes may be preset in the integrated control apparatus by an operator's selection.

The determination of the auto change of power mode may be performed by comparing a duration time of an auto mode change index existing in the auto change boundary region with a standard time. That is, when the pump power exists between upper limit and lower limit of each power mode, the auto change of power mode may not be performed.

For example, the change of power mode of the hydraulic pump 20 may be performed as follows.

In case that auto mode change index exceeds upper limit of S mode for time $\Delta t\mathbf{1}$, $\Delta t\mathbf{1}$ may be less than a first standard time $\Delta t_limit$, and thus, current S mode may be maintained.

In case that auto mode change index exceeds upper limit of S mode for time $\Delta t\mathbf{2}$, $\Delta t\mathbf{2}$ may be greater than the first standard time $\Delta t_limit$, and thus, current power mode may be increased to P mode.

In case that auto mode change index decreases under lower limit of P mode for time $\Delta t\mathbf{3}$, $\Delta t\mathbf{3}$ may be greater than a second standard time $\Delta t_limit$, and thus, current power mode may be decreased to S mode.

In case that auto mode change index decreases under lower limit of S mode for time $\Delta t\mathbf{4}$, $\Delta t\mathbf{4}$ may be greater than a third standard time $\Delta t_limit$, and thus, current power mode may be decreased to E mode.

The first to third standard times may have different values at each power mode, and the standard time for increasing power mode may be the same as or different from the standard time for decreasing power mode. The standard time at each mode and upper or lower limit may be determined in consideration of productivity and performance in development stage. Additionally, these values may be altered or modified by requests of a customer (equipment user, operator), etc.

Hereinafter, a method of controlling an engine and a hydraulic pump using the integrated control apparatus in FIG. 2 will be explained.

Figure 9:
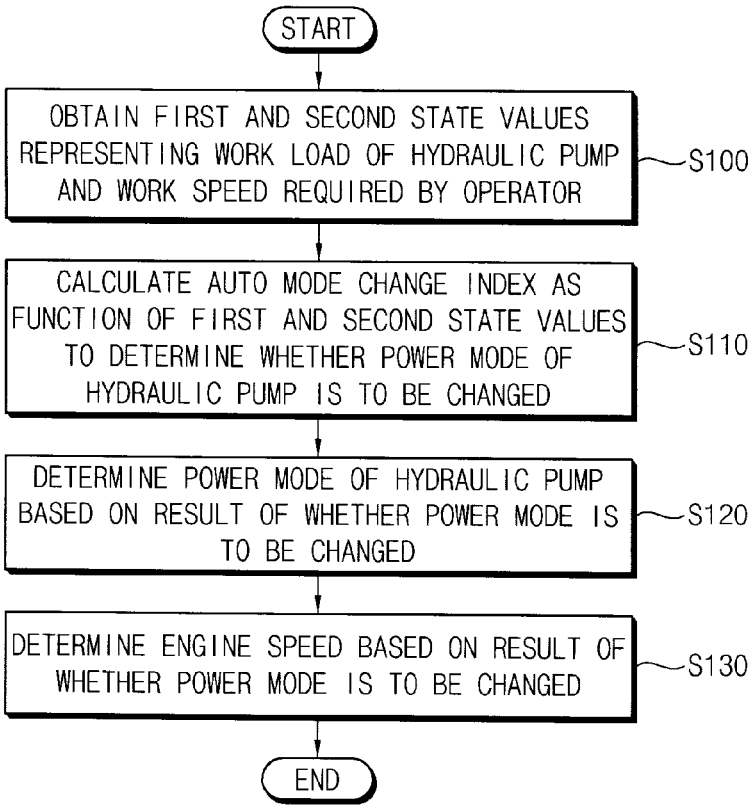

FIG. 9 is a flow chart illustrating an integrated control method for engine and hydraulic pump in accordance with example embodiments.

Referring to FIGS. 1 and 9, a first state value representing a work load of a hydraulic pump 20 and a second state value representing a work speed required by an operator may be obtained (S100).

In example embodiments, when an operator selects an auto mode (A mode) as power mode, an initial mode in A mode may be preset to S mode or E mode. When an operator begins work, an output ratio of an engine 10 and the hydraulic pump 20 may be controlled at the initial mode. In the progress of work, the first state value representing a work load exerted on a working apparatus and the second state value representing a work speed required by an operator may be obtained.

In case of a NegaCon type control method using a negative control pressure, the first state value may be a discharge pressure Pd of a hydraulic oil discharged from the hydraulic pump 20, and the second state value may be a negative control pressure Ne of the hydraulic oil passing through a control valve 30. In case of a control method without using the negative control pressure, the first state value may be a discharge pressure Pd of the hydraulic pump 20 and the second state value may be a pilot pressure Pi in proportion to an operation rate of an operation lever in an operating unit 50. In this case, an auto mode change index may be determined as a multiplication of the discharge pressure Pd and the pilot pressure Pi, not a ratio of the discharge pressure Pd to the pilot pressure Pi. It is because behaviors of the NegaCon pressure and the pilot pressure Pi are inversely proportional to each other in a hydraulic system. As a manipulation amount of an operation lever is increased, the NegaCon pressure of the hydraulic oil discharged from the main control valve may be reduced, but the pilot pressure in proportion to the manipulation amount of the operation lever may be increased. In order to apply the Upper/lower limit and the duration time the same as those preset in the NegaCon type control system, the reciprocal of the pilot pressure may be used, and thus, an auto mode change index may be defined as a multiplication of the discharge pressure Pd and the pilot pressure Pi.

Then, an auto mode change index may be calculated as a function of the first state value and the second state value to determine whether a power mode of the hydraulic pump is to be changed (S110).

In example embodiments, the auto mode change index may be defined such that a load of a working apparatus and an operator's request may be efficiently detected. In particular, the auto mode change index may be determined as a ratio of the discharge pressure Pd of the hydraulic pump and the NegaCon pressure Ne or as a multiplication of the discharge pressure Pd of the hydraulic pump and the pilot pressure Pi.

For example, 1) in case of high work load and fast work speed, auto mode change index may be high, and thus, current power mode may be changed to higher power mode. That is, in case of high work load (high discharge pressure Pd), fast work speed and operator's high input value (low negative control pressure Ne), a power mode may be increased to a higher mode.

2) In case of high work load and slow work speed, auto mode change index may be low, and thus, current power mode may be maintained. That is, in case of high work load (high Pd), slow work speed and operator's low input value (high Ne), current power mode may be maintained.

3) In case of low work load and fast work speed, auto mode change index may be low, and thus, current power mode may be maintained. That is, in case of low work load (low Pd), fast work speed and operator's high input value (low Ne), current power mode may be maintained.

4) In case of low work load and slow work speed, auto mode change index may be lower, and thus, current power mode may be changed to a lower power mode. That is, in case of low work load (low Pd), slow work speed and operator's low input value (high Ne), a power mode may be decreased to a lower mode.

Alternatively, the auto mode change index may be determined as a function of a pump power of the hydraulic pump and the NegaCon pressure (or pilot pressure). In this case, the pump power of the hydraulic pump 20 may be estimated from a discharge volume of the hydraulic pump 20 and a discharge pressure of the hydraulic pump 20. A pump torque of the hydraulic pump 20 may be estimated using a table obtained from measurement tests. The pump power of the hydraulic pump 20 may be calculated from the pump torque and an engine speed (rpm) of an engine 10 detected by an engine speed sensor.

The current power mode and the auto mode change index may be used as an input value, a standard time (time limit) for each mode may be preset as a power mode change standard, and the calculated auto mode change index may be evaluated to determine whether a current power mode is to be changed.

For example, 1) in case that auto mode change index is higher than upper limit of current power mode (high work load and operator's low input value), current power mode may be maintained. 2) In case that auto mode change index is lower than upper limit of current power mode (actual work load is not high and operator's input is high), a power mode may be increased to a higher mode. 3) In case that auto mode change index is higher than lower limit of current power mode (high work load and an operator's low input value), current power mode may be maintained. 4) In case that auto mode change index is lower than lower limit of current power mode (low work load and operator's low input), a power mode may be decreased to a lower mode.

Then, a power mode of the hydraulic pump may be determined based on a result of whether a power mode is to be changed (S120). A pump controller 68 may control a power mode of the hydraulic pump 20 based on a power mode command signal for power mode increase/decrease/maintenance.

Then, an engine speed may be determined based on the result of whether a power mode is to be changed (S130). An engine controller 72 of an engine control unit 70 may control a speed of the engine 10 such that power matching of the engine with the newly determined power mode of the hydraulic pump 20 can be achieved easily and consistently.

As mentioned above, when an operator selects an auto mode as a power mode in a hydraulic system, an auto mode change index may be calculated based on a work load of the hydraulic pump and a work speed required by an operator to determine whether a current power mode of the hydraulic pump is to be changed. A power mode of the hydraulic pump as well as a speed of the engine may be determined based on a result of whether a current power mode of the hydraulic pump is to be changed.

Thus, the auto mode in the construction machine may provide convenience in selection of an optimal power mode for an unskilled operator, who cannot select skillfully a proper mode of a plurality of the power modes in different working situations. Further, the engine and the hydraulic pump may be controlled together in consideration of an output (power) of the vehicle, thereby obtaining improved fuel efficiency due to a reduction of torque requirement of the hydraulic pump.

The foregoing is illustrative of example embodiments and is not to be construed as limiting thereof. Although a few example embodiments have been described, those skilled in the art will readily appreciate that many modifications are possible in the example embodiments without materially departing from the novel teachings and advantages of the present inventive concept. Accordingly, all such modifications are intended to be included within the scope of the present inventive concept as defined in the claims. In the claims, means-plus-function clauses are intended to cover the structures described herein as performing the recited function and not only structural equivalents but also equivalent structures. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims.

The invention claimed is:

1. An integrated control apparatus for an engine and a hydraulic pump in an engine system, the engine system including the engine and the hydraulic pump driven by the engine, a control valve for controlling a hydraulic oil discharged from the hydraulic pump and a hydraulic actuator operated by the hydraulic oil from the control valve, the engine and the hydraulic pump being controllable according to a predetermined output ratio in a selected mode of a plurality of power modes, the integrated control apparatus comprising:

a power mode determiner configured to calculate an auto mode change index as a function of a first state value representing a work load of the hydraulic pump and a second state value representing a work speed required by an operator, in a pump control device, to determine whether a current power mode of the hydraulic pump is to be changed based on the calculated auto mode change index;

a pump power determiner configured to select one of the power modes based on a result of whether the current power mode of the hydraulic pump is to be changed, in the pump control device; and an engine speed determiner configured to determine an engine speed according to the selected power mode, in the pump control device, wherein the first state value comprises a discharge pressure of the hydraulic oil discharged from the hydraulic pump, or a pump power or a pump torque of the hydraulic pump, and wherein the second state value comprises a negative control pressure or a pilot pressure corresponding to a control method in a hydraulic system.

2. The integrated control apparatus of claim 1, wherein the power mode determiner comprises:

a change index calculator configured to calculate the auto mode change index as a ratio of the first state value and the second state value; and a change index determiner configured to select one of the power modes to which the current power mode of the hydraulic pump is to be changed, based on the calculated auto mode change index.

3. The integrated control apparatus of claim 2, wherein the power mode determiner further comprises a change standard determiner configured to determine a power mode change standard using the current power mode and the auto mode change index as an input value.

4. The integrated control apparatus of claim 1, further comprising a pump power calculator configured to calculate a pump power of the hydraulic pump from the pump torque of the hydraulic pump and an engine speed.

5. The integrated control apparatus of claim 4, wherein the pump torque is obtained from a discharge volume of the hydraulic pump and a discharge pressure of the hydraulic pump.

6. The integrated control apparatus of claim 5, wherein the discharge volume is calculated using the discharge pressure, the negative control pressure and a power shift control pressure.

7. The integrated control apparatus of claim 1, wherein when an operator selects an auto mode as a power mode, the power mode determiner is configured to determine whether the current power mode of the hydraulic pump is to be changed.

8. The integrated control apparatus of claim 1, wherein the determination of the auto change of power mode is performed by comparing a duration time of the auto mode change index existing in the auto change boundary region with a standard time.

9. An integrated control method for an engine and a hydraulic pump, the hydraulic pump driven by the engine and discharging a hydraulic oil for operating a hydraulic actuator, comprising:

providing a plurality of power modes, the engine and the hydraulic pump being controlled according to a predetermined output ratio in a selective mode of the power modes;

obtaining a first state value representing a work load of the hydraulic pump and a second state value representing a work speed required by an operator, wherein the first state value comprises a discharge pressure of the hydraulic oil discharged from the hydraulic pump, or a pump power or a pump torque of the hydraulic pump, and wherein the second state value comprises a negative control pressure or a pilot pressure corresponding to a control method in a hydraulic system;

calculating, using a power mode determiner and a pump power determiner, an auto mode change index as a function of the first state value and the second state value to determine whether a current power mode of the hydraulic pump is to be changed based on the calculated auto mode change index and responsively select one of the power modes;

controlling the hydraulic pump according to the selected power mode; and controlling an engine speed of the engine according to the selected power mode.

10. The integrated control method of claim 9, wherein determining whether the current power mode of the hydraulic pump is to be changed comprises:

calculating the auto mode change index as a ratio of the first state value and the second state value; and determining a new power mode to which the current power mode of the hydraulic pump is to be changed based on the auto mode change index.

11. The integrated control method of claim 10, wherein determining whether the current power mode of the hydraulic pump is to be changed further comprises determining a power mode change standard using the current power mode and the auto mode change index as an input value.

12. The integrated control method of claim 9, further comprising calculating a pump power of the hydraulic pump from the pump torque of the hydraulic pump and an engine speed.

13. The integrated control method of claim 12, wherein the pump torque is obtained from a discharge volume of the hydraulic pump and a discharge pressure of the hydraulic pump.

14. The integrated control method of claim 13, wherein the discharge volume is calculated using the discharge pressure, the negative control pressure and a power shift control pressure.

15. The integrated control method of claim 9, wherein when an operator selects an auto mode as a power mode, determining whether the current power mode of the hydraulic pump is to be changed is performed.

16. The integrated control method of claim 9, wherein determining whether the current power mode of the hydraulic pump is to be changed comprises comparing a duration time of the auto mode change index existing in the auto change boundary region with a standard time.

17. An integrated control apparatus for an engine and a hydraulic pump in an engine system, the engine system including the engine and the hydraulic pump driven by the engine, a control valve for controlling a hydraulic oil discharged from the hydraulic pump and a hydraulic actuator operated by the hydraulic oil from the control valve, the engine and the hydraulic pump being controllable according to a predetermined output ratio in a selected mode of a plurality of power modes, the integrated control apparatus comprising:

a pump control device configured to calculate an auto mode change index as a function of a first state value representing a work load of the hydraulic pump and a second state value representing a work speed required by an operator to determine whether a current power mode of the hydraulic pump is to be changed based on the calculated auto mode change index and responsively select one of the power modes, and operatively connected to the hydraulic pump for controlling the hydraulic pump according to the selected power mode; and an engine control unit operatively connected to the pump control device for controlling an engine speed of the engine according to the selected power mode, wherein the first state value comprises a discharge pressure of the hydraulic oil discharged from the hydraulic pump, or a pump power or a pump torque of the hydraulic pump, and wherein the second state value comprises a negative control pressure or a pilot pressure corresponding to a control method in a hydraulic system.

18. The integrated control apparatus of claim 17, wherein the pump control device comprises:

a power mode determiner configured to calculate the auto mode change index as a ratio of the first state value and the second state value;

a pump power determiner configured to select one of the power modes based on the calculated auto mode change index; and an engine speed determiner configured to determine the engine speed based on the selected power mode.

19. The integrated control apparatus of claim 1, wherein when an operator selects an auto mode as a power mode, the pump control device is configured to determine whether the current power mode of the hydraulic pump is to be changed.

20. The integrated control apparatus of claim 1, wherein the determination of the auto change of power mode is performed by comparing a duration time of the auto mode change index existing in the auto change boundary region with a standard time.

* * * * *